US010273716B2

(12) United States Patent
Huang

(10) Patent No.: US 10,273,716 B2
(45) Date of Patent: Apr. 30, 2019

(54) REKEYABLE LOCK

(71) Applicant: TAIWAN FU HSING INDUSTRIAL CO., LTD., Kaohsiung (TW)

(72) Inventor: Fu-Chih Huang, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 15/908,933

(22) Filed: Mar. 1, 2018

(65) Prior Publication Data

US 2019/0024410 A1 Jan. 24, 2019

(30) Foreign Application Priority Data

Jul. 18, 2017 (TW) ..... 106210514 U

(51) Int. Cl.
*E05B 27/00* (2006.01)

(52) U.S. Cl.
CPC ..... *E05B 27/005* (2013.01); *E05B 27/0021* (2013.01)

(58) Field of Classification Search
CPC ..... E05B 27/005; E05B 27/0021; E05B 27/0014; E05B 27/0007
USPC ..... 70/382–385, 493–495, 372, 373, 375, 70/358, 337–343, DIG. 44, DIG. 37, 70/DIG. 71, 367–371, 379 R, 379 A, 380, 70/381, 391
See application file for complete search history.

(56) References Cited

U.S. PATENT DOCUMENTS 1,414,348 A * 5/1922 Falk ..... E05B 27/001 70/373
2,620,649 A * 12/1952 Bernardo ..... E05B 27/00 70/358
2,877,638 A * 3/1959 Muttart ..... E05B 27/0014 70/224
2,949,762 A * 8/1960 Johnstone ..... E05B 29/00 70/495
2,977,786 A * 4/1961 Kendrick ..... E05B 9/04 70/373
4,138,870 A * 2/1979 Poirier ..... E05B 9/086 70/372
4,531,389 A * 7/1985 Foshee ..... E05B 17/0004 70/372
4,531,390 A * 7/1985 Best ..... E05B 27/0014 70/372
4,689,978 A * 9/1987 Drummond ..... E05B 9/04 70/372

(Continued)

*Primary Examiner* — Lloyd A Gall
(74) *Attorney, Agent, or Firm* — Jackson IPG PLLC; Demian K. Jackson

(57) ABSTRACT

A rekeyable lock includes a cylinder, a plug and a blocker. The cylinder includes a main body, an accommodation hole and a through hole penetrating through the main body and communicating with the accommodation hole. The plug is rotatably disposed in the accommodation hole. The blocker is movably disposed in the accommodation hole and includes a block portion and a position portion connecting with each other. The block portion is located between the main body and the plug. The position portion protrudes outside the accommodation hole via the through hole and positioned on a steady portion of the main body. The bottom pins can be removed from or blocked in the plug by the blocker for key replacement, and the position of the block portion can be easily adjusted by the position portion protruding outside the accommodation hole for rapidly replacing the bottom pins.

8 Claims, 11 Drawing Sheets

(56) References Cited

U.S. PATENT DOCUMENTS 4,732,023 A * 3/1988 Shen ..... E05B 27/005 70/358
5,038,589 A * 8/1991 Martin ..... E05B 9/084 70/368
5,617,750 A * 4/1997 Preddey ..... E05B 27/0042 70/356
5,704,234 A * 1/1998 Resch ..... B60R 25/021 70/371
6,425,274 B1 * 7/2002 Laitala ..... E05B 67/24 70/279.1
6,810,703 B1 * 11/2004 Huang ..... E05B 27/0014 70/367
6,951,123 B2 * 10/2005 Chong ..... E05B 27/005 70/367
7,121,127 B1 * 10/2006 Fan ..... E05B 27/005 70/373
8,166,784 B2 * 5/2012 Tong ..... E05B 27/0014 70/373
8,424,349 B2 * 4/2013 Marcelle ..... E05B 29/004 70/338
8,707,746 B1 * 4/2014 Liu ..... E05B 27/005 70/383
8,893,536 B2 * 11/2014 Huang ..... E05B 27/005 70/340
9,200,473 B2 * 12/2015 Fan ..... E05B 27/005
9,260,884 B2 * 2/2016 Li ..... E05B 27/005
2003/0167809 A1 * 9/2003 Huang ..... E05B 17/04 70/379 R
2010/0037666 A1 * 2/2010 Chong ..... E05B 27/005 70/490
2011/0232342 A1 * 9/2011 Tong ..... E05B 27/0014 70/449
2014/0250960 A1 * 9/2014 Li ..... E05B 27/005 70/493

* cited by examiner

REKEYABLE LOCK

FIELD OF THE INVENTION

This invention relates to a lock, and more particularly relates to a rekeyable lock.

BACKGROUND OF THE INVENTION

Pin tumbler lock is one of the most common lock in the market and conventionally includes a housing, a plug, top pins and bottom pins. The top pins are placed in an accommodation space of the housing and the bottom pins corresponding to the top pins are placed in linear grooves of the plug. The top pins are pushed by springs to push the bottom pins and cross a shear line between the plug and the housing because of the bottom pins having different lengths such that can block the turning of the plug for locking. When a key is inserted into a key way of the plug, the bottom pins and the top pins are pushed upward. And if the inserted key is the correct key, it can rotate the plug to unlock because the boundary between the top and bottom pins is pushed to align along the shear line.

Based on the stability and security, the top and bottom pins of the conventional pin tumbler lock are confined in the accommodation space of the housing and the linear grooves of the plug, respectively, and it is difficult to take out the pins from the lock. Key replacement of the conventional lock is not easy because the shapes of the key cuts are determined by the lengths of the bottom pins that cannot be removed from the lock. As a result, the whole lock has to be changed when intending to replace the key.

SUMMARY

The primary object of the present invention is to provide a movable blocker able to block bottom pins and allow bottom pins to be replaced for rapid key replacement.

The rekeyable lock of the present invention includes a cylinder, a plug and a blocker. The cylinder has a main body, an accommodation hole and a through hole penetrating through the main body and communicating with the accommodation hole. The plug is rotatably disposed in the accommodation hole. The blocker is movably disposed in the accommodation hole and includes a block portion and a position portion connecting with each other. The block portion is located between the main body and the plug. The position portion protrudes outside the accommodation hole via the through hole and is positioned on a steady portion of the main body.

In the rekeyable lock of the present invention, the blocker movably disposed in the accommodation hole is provided to allow the bottom pins to be removed from the through hole or restricted in the cylinder. Otherwise, owing to the position portion of the blocker is positioned on the steady portion of the main body, the user can move the blocker by hand or simple tool to replace the bottom pins for replacing key rapidly.

DETAILED DESCRIPTION OF THE INVENTION

Figure 1:
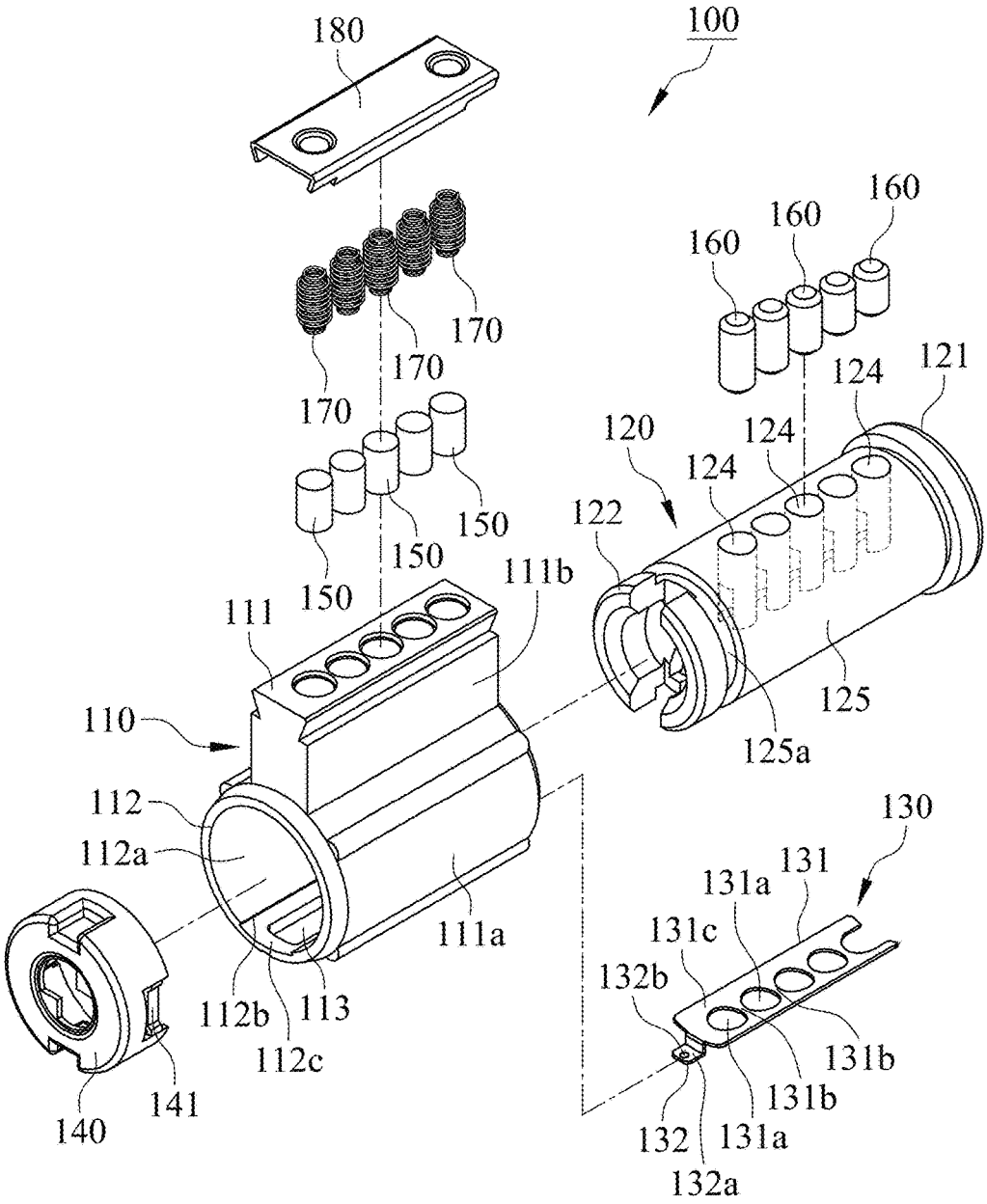
FIG. 1 is a perspective exploded diagram illustrating a rekeyable lock in accordance with a first embodiment of the present invention.
Figure 2:
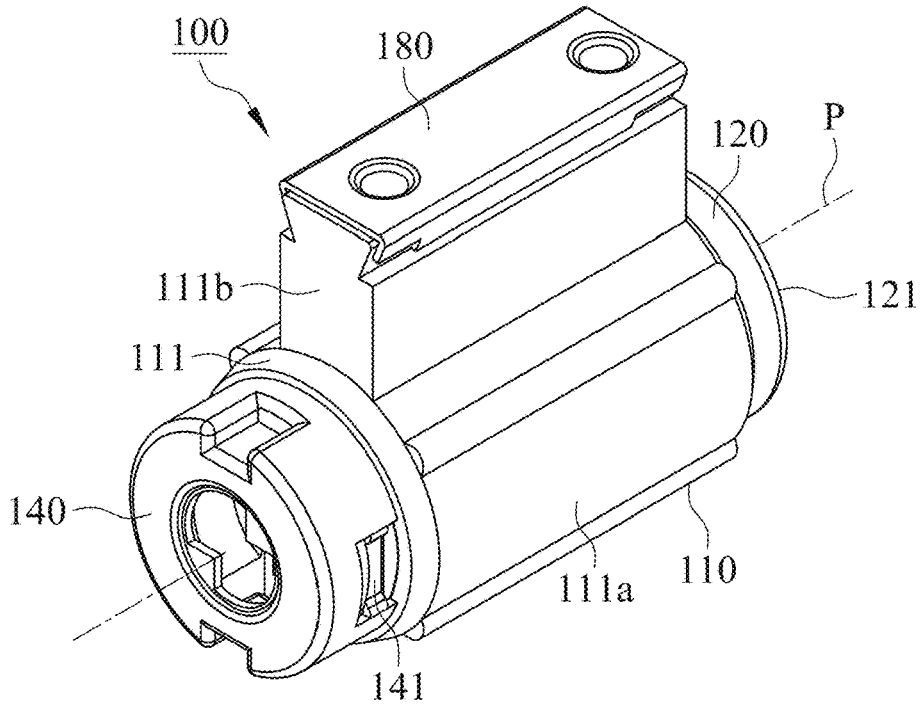
FIG. 2 is a perspective assembly diagram illustrating the rekeyable lock in accordance with the first embodiment of the present invention.

With reference to FIGS. 1 and 2, a rekeyable lock 100 of a first embodiment of the present invention includes a cylinder 110, a plug 120, a blocker 130, a stop ring 140, a plurality of top pins 150, a plurality of bottom pins 160 and a plurality of elastic elements 170.

With reference to FIGS. 1 and 2, the cylinder 110 includes a main body 111, an accommodation hole 112 and a through hole 113. The through hole 113 penetrates through the main body 111 and communicates with the accommodation hole 112. The main body 111 has a plug-accommodation part 111*a* and a top pin-accommodation part 111*b* connecting with each other, and the top pin-accommodation part 111*b* is used to accommodate the top pins 150 and the elastic elements 170. A lid 180 is further provided to restrict the top pins 150 and the elastic elements 170 in the top pin-accommodation part 111*b*. The accommodation hole 112 is formed in the plug-accommodation part 111*a* and is used for accommodating the plug 120.

Figure 3:
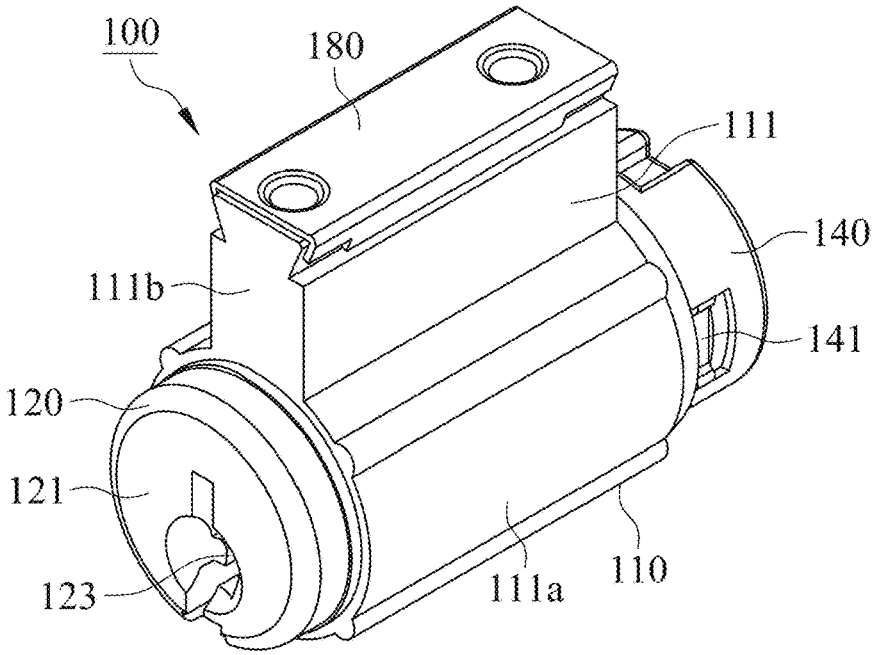
FIG. 3 is a perspective assembly diagram illustrating the rekeyable lock in accordance with the first embodiment of the present invention.

With reference to FIGS. 1, 2 and 3, the plug 120 is rotatably disposed within the accommodation hole 112 of the cylinder 110 and includes a key end 121, a stop end 122, a key hole 123, a plurality of linear grooves 124 and an external ring surface 125. A key (not shown) is able to be inserted into the key hole 123 located at the key end 121 for locking or unlocking. The linear grooves 124 are recessed on the external ring surface 125 for accommodating the bottom pins 160. Furthermore, the linear grooves 124 are corresponding to the top pins 150 and able to allow the top pins 150 to align and push the bottom pins 160. The stop ring 140 is engaged with the stop end 122 and rotates together with the plug 120, so the plug 120 can inhibit or permit the operation of a latch assembly (not shown) through the stop ring 140. Owing to the stop ring 140 and the key end 121 both have an outer diameter larger than an inner diameter of the accommodation hole 112, the plug 120 cannot move axially along an axis P when it is put in the accommodation hole 112 and engaged with the stop ring 140.

Figure 4:
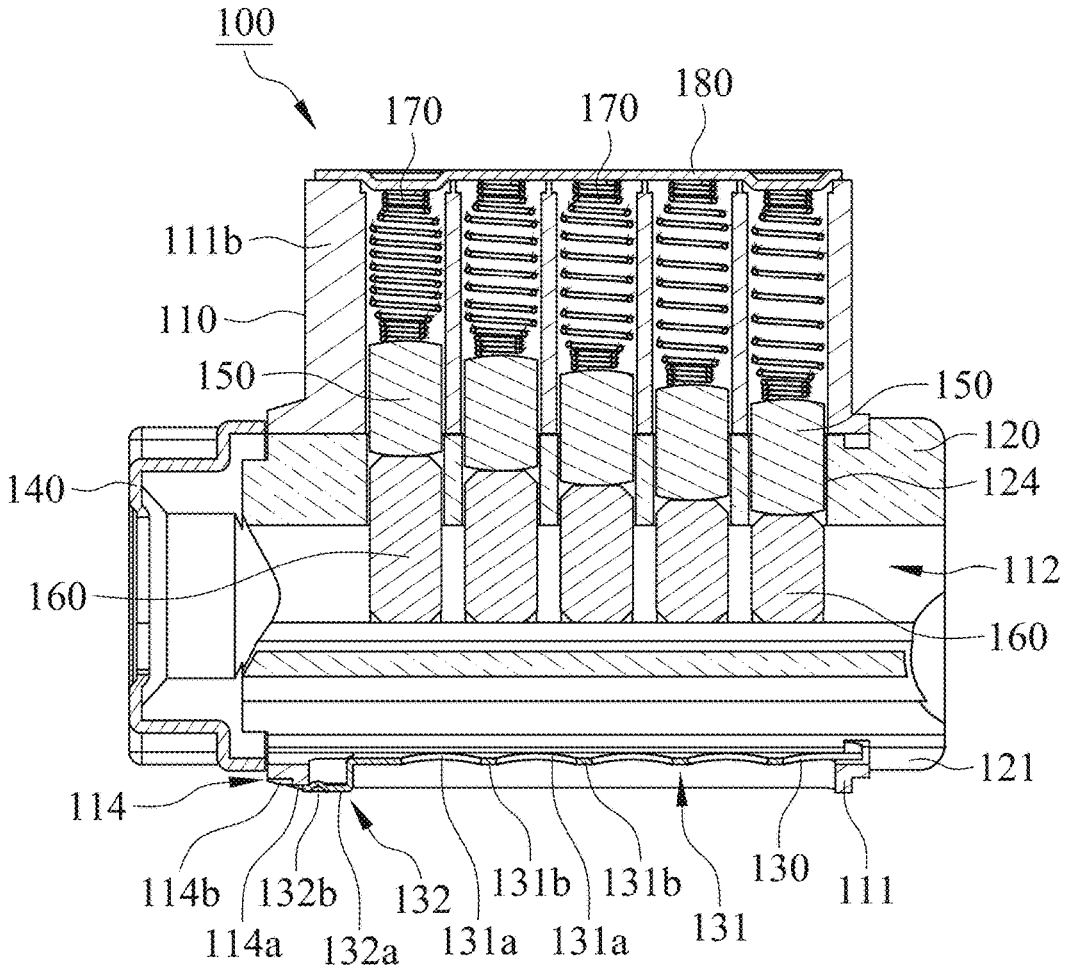
FIG. 4 is a cross-section view diagram illustrating the rekeyable lock in accordance with the first embodiment of the present invention.
Figure 5:
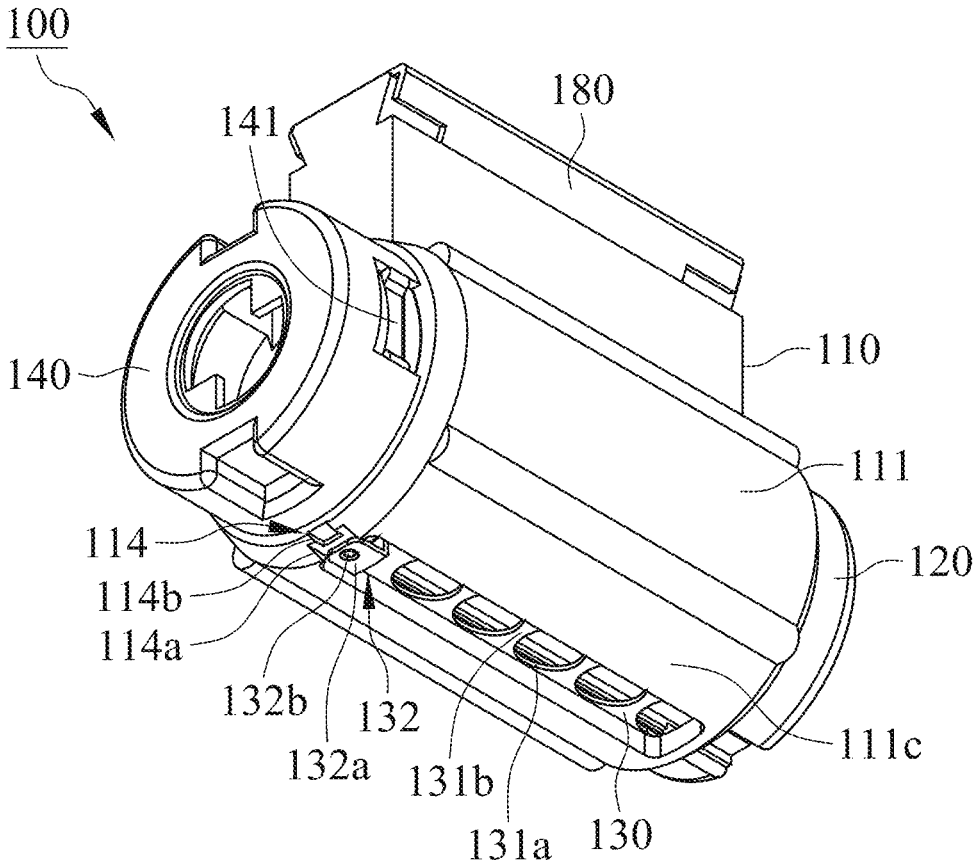
FIG. 5 is a perspective assembly diagram illustrating the rekeyable lock in accordance with the first embodiment of the present invention.

With reference to FIGS. 1, 4 and 5, the blocker 130 is movably disposed in the accommodation hole 112 and able to move between a first position and a second position. The blocker 130 includes a block portion 131 and a position portion 132 connecting with each other. The block portion 131 is located between the main body 111 and the plug 120, and the position portion 132 protrudes outside the accommodation hole 112 via the through hole 113 and is positioned on a steady portion 114 of the main body 111. Preferably, there are a plurality of bores 131*a* and a plurality of connection ribs 131*b* aligned alternately on the block portion 131, and the position portion 132 includes a flexible arm 132*a* and an emboss 132*b* located on the flexible arm 132*a*.

With reference to FIGS. 1 and 4, a guide groove 112*b* is preferably recessed on a hole wall 112*a* of the accommodation hole 112 and the through hole 113 is formed on a bottom surface 112*c* of the guide groove 112*b*. The blocker 130 is placed in the guide groove 112*b* that is used to guide the blocker 130 move axially along the axis P. Additionally, a top surface 131*c* of the block portion 131 will not protrude from the hole wall 112*a* of the accommodation hole 112 to interfere with the plug 120 because the blocker 130 is placed in the guide groove 112*b*. As a result, the uneven rotation of the plug 120 can be avoided.

With reference to FIGS. 4 and 5, in the first embodiment, the steady portion 114 of the main body 111 is located on an external surface 111*c* of the main body 111 and has a steady concave 114*a* recessed on the external surface 111*c*. Preferably, there is a position concave 114*b* recessed in the steady concave 114*a*. The steady concave 114*a* is provided to accommodate the position portion 132 of the blocker 130 in order to prevent the position portion 132 from protruding from the external surface 111*c*.

With reference to FIGS. 4 and 5, when the position portion 132 is located in the through hole 113, the position of the blocker 130 is defined as the first position. The emboss 132*b* of the position portion 132 is obstructed by the steady portion 114 of the cylinder 110 and the other end of the blocker 130, opposite to the position portion 132, is obstructed by the key end 121 of the plug 120, so the blocker 130 is confined in the guide groove 112*b* by the steady portion 114 of the cylinder 110 and the key end 121 of the plug 120 to prevent the blocker 130 from swaying in the guide grove 112*b*.

With reference to FIG. 4, the top pins 150 pushed by the elastic elements 170 are able to respectively push one of the bottom pins 160, and the border between the top pins 150 and the bottom pins 160 is not continuous because of the bottom pins 160 having different lengths, such that the top pins 150 cross a shear line between the cylinder 110 and the plug 120 to block the rotation of the plug 120.

Figure 6:
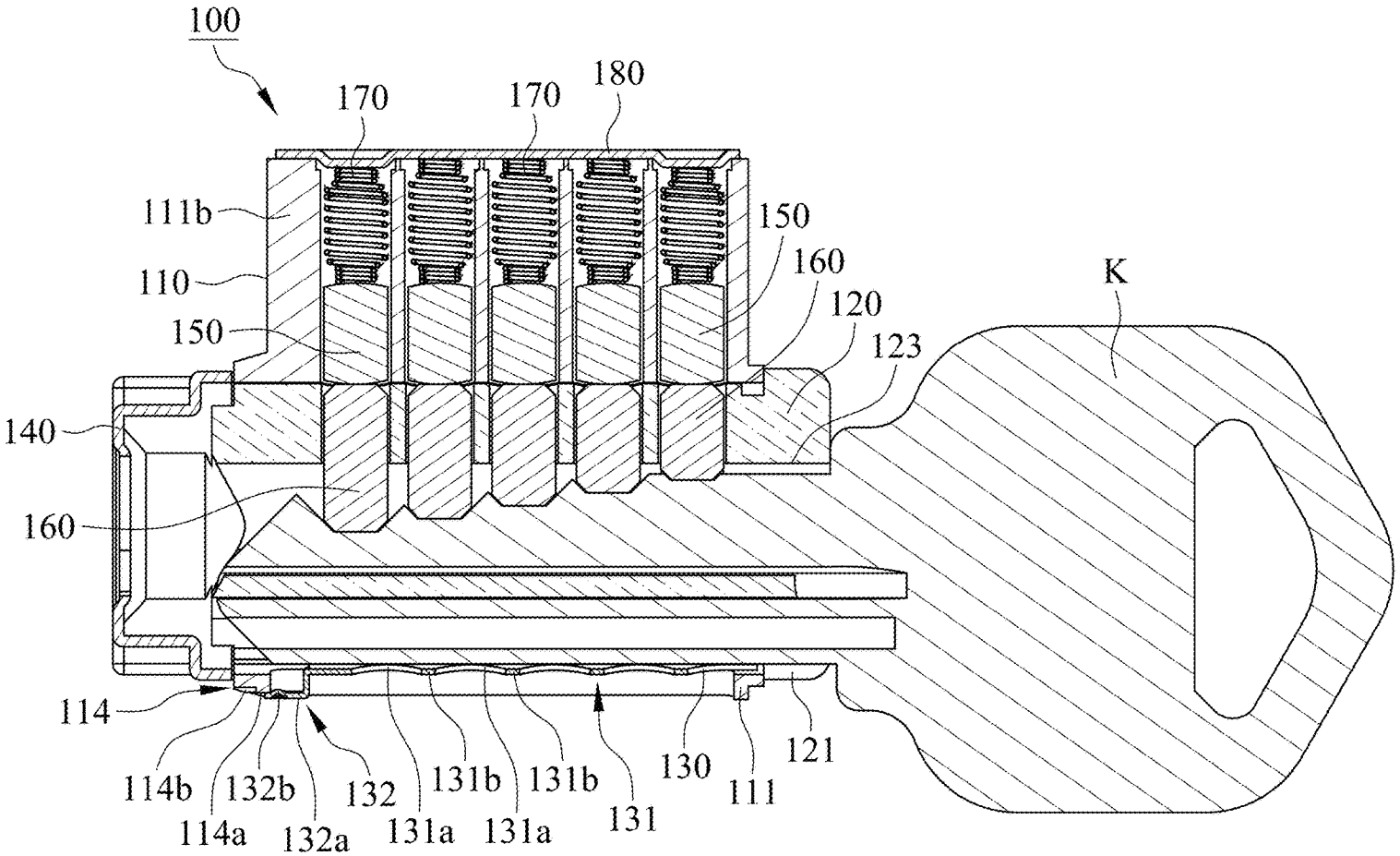
FIG. 6 is a cross-section view diagram illustrating a key inserting into the rekeyable lock in accordance with the first embodiment of the present invention.
Figure 7:
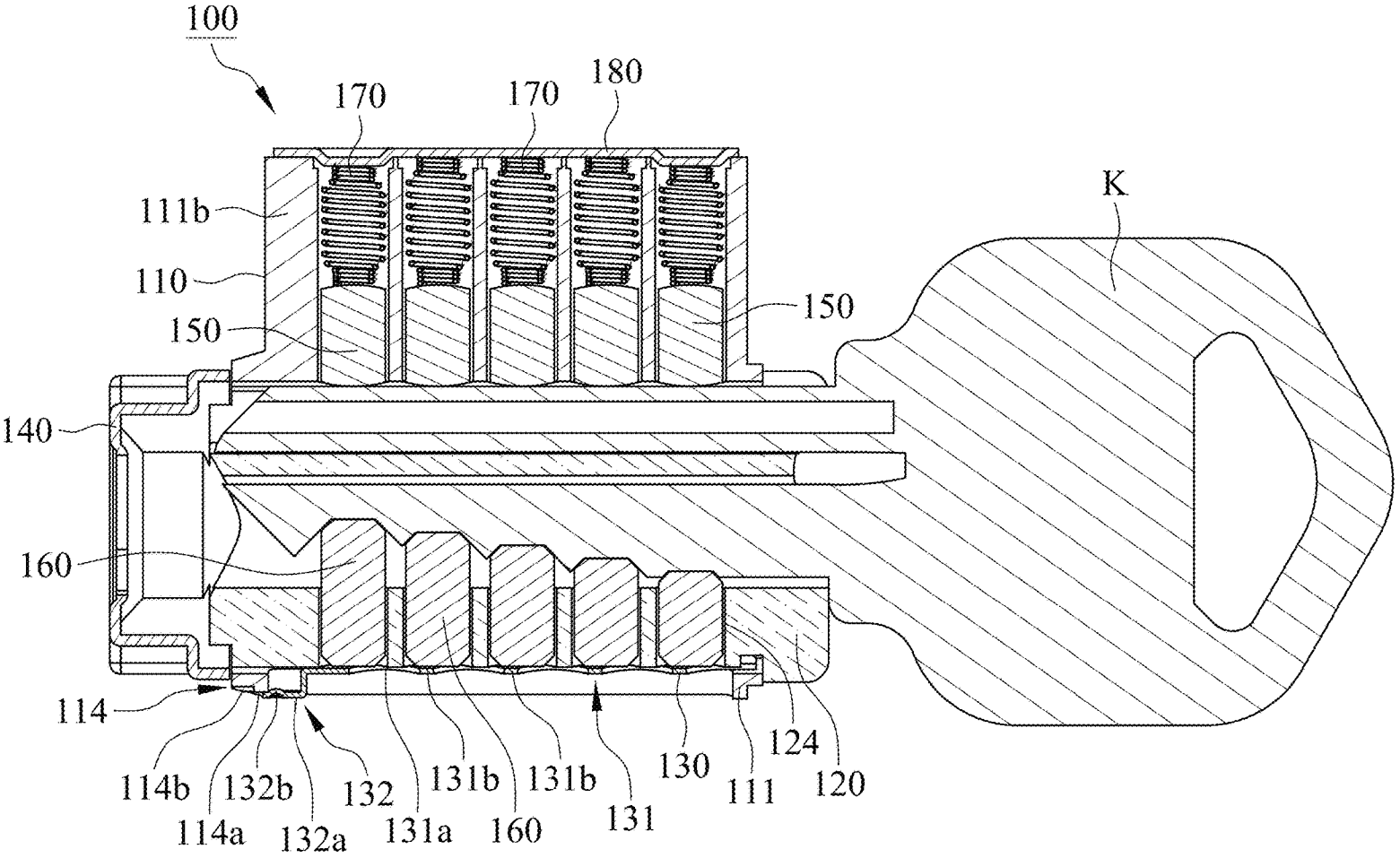
FIG. 7 is a cross-section view diagram illustrating the key inserting into the rekeyable lock in accordance with the first embodiment of the present invention.
Figure 8:
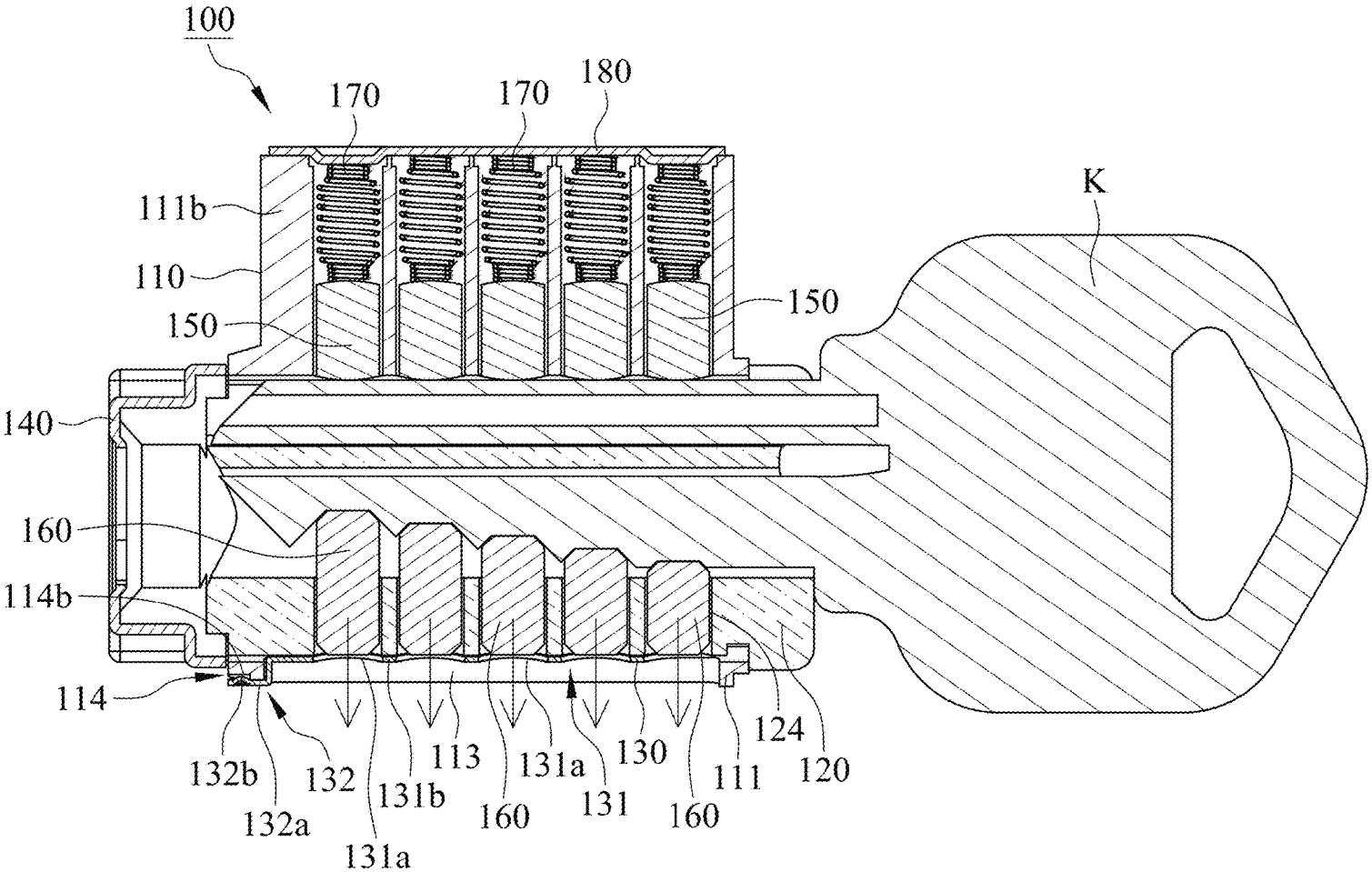
FIG. 8 is a cross-section view diagram illustrating the key inserting into the rekeyable lock in accordance with the first embodiment of the present invention.
Figure 9:
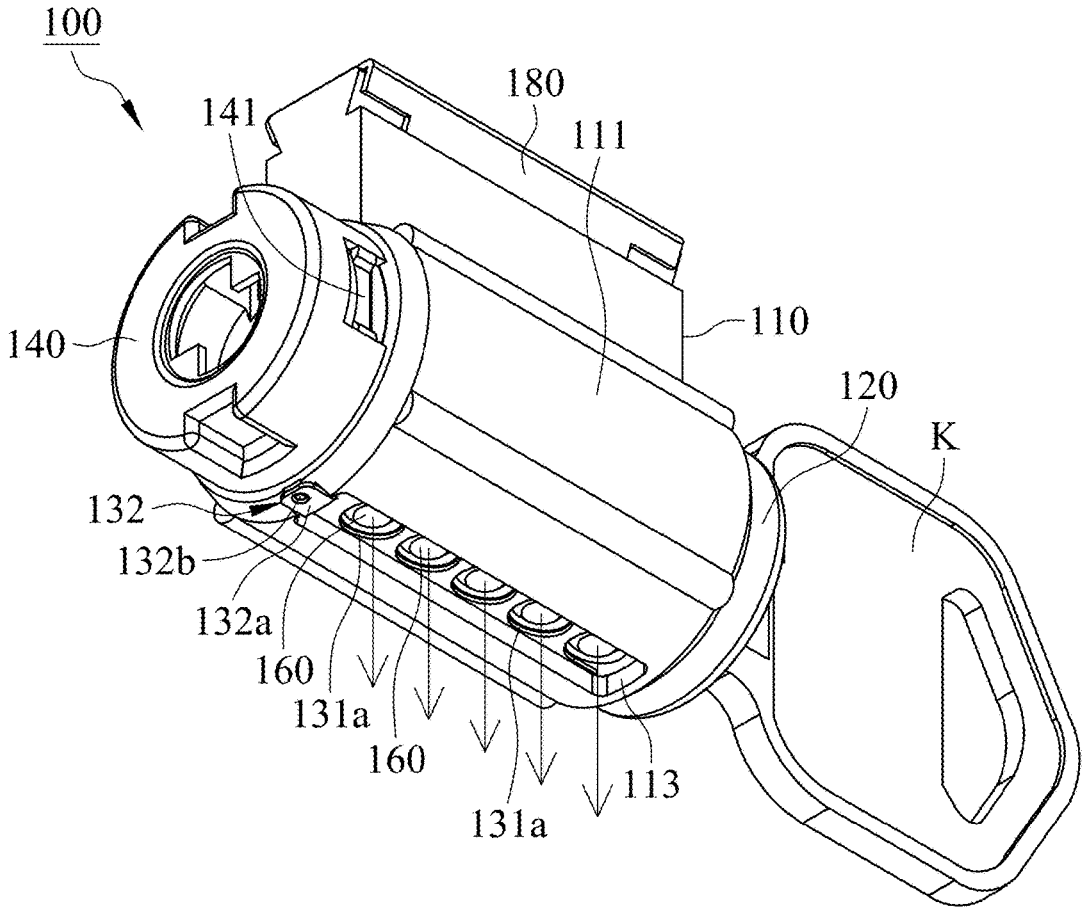
FIG. 9 is a perspective assembly diagram illustrating the rekeyable lock in accordance with the first embodiment of the present invention.

FIGS. 6 to 9 are the drawings illustrating the operation of the rekeyable lock 100 during key replacement. With reference to FIG. 6, when a correct key K is inserted into the key hole 123 of the plug 120 by a user, key cuts of the key K can push the bottom pins 160 and the top pins 150 upward to allow the border between the bottom pins 160 and the top pins 150 to align along the shear line between the cylinder 110 and the plug 120. At this time the user can rotate the plug 120 via the key K. With reference to FIG. 7, the linear grooves 124 face toward the through hole 113 of the cylinder 110 when the plug 120 is rotated by 180 degrees. However, the bottom pins 160 are still blocked by the connection ribs 131*b* of the block portion 131 and unable to be removed due to the blocker 130 at the first position. With reference to FIGS. 8 and 9, when the blocker 130 is moved from the first position to the second position, the bottom pins 160 are revealed by the bores 131*a* and able to be taken out through the bores 131*a* and the through hole 113 of the cylinder 110. After removing the bottom pins 160, the user can draw out the original key K, place new bottom pins 160 into the linear grooves 124 of the plug 120 and insert a new key into the key hole 123, then he/she needs to move the blocker 130 back to the first position from the second position to block the bottom pins 160 and rotate the plug 120 by 180 degrees to the original position via the new key to complete the key replacement.

With reference to FIGS. 8 and 9, when the blocker 130 is located at the second position, the flexible arm 132*a* of the position portion 132 is located in the steady concave 114*a* and the emboss 132*b* is accommodated in the position concave 114*b*. The elasticity of the flexible arm 132*a* can block the emboss 132*b* in the position concave 114*b* to keep the position of the blocker 130 and prevent the blocker 130 from swaying during removing the bottom pins 160.

Figure 10:
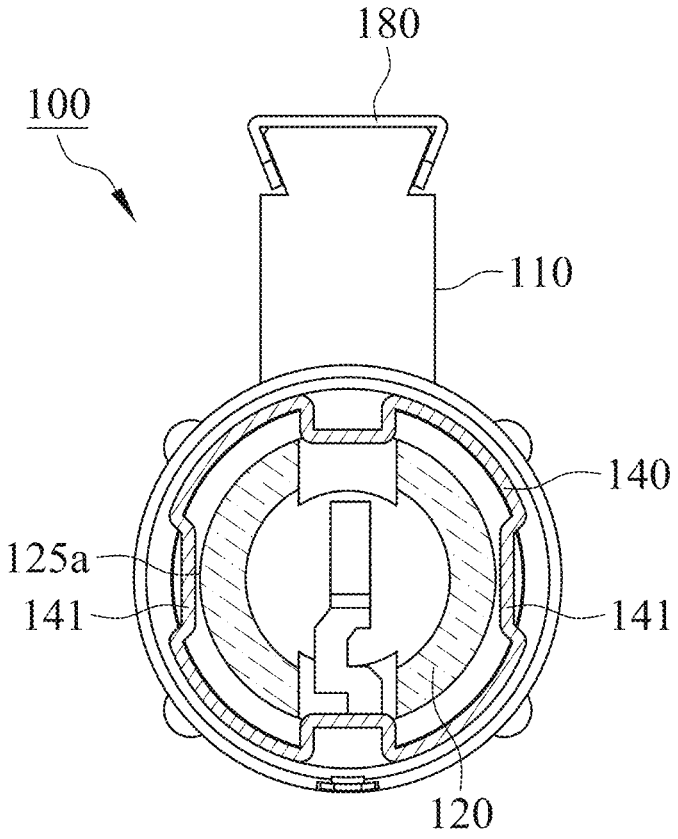
FIG. 10 is a cross-section view diagram illustrating the rekeyable lock in accordance with the first embodiment of the present invention.

With reference to FIGS. 1, 2 and 10, a restriction groove 125*a* is preferably recessed on the external ring surface 125 of the plug 120 and radially extends around the axis P passing through the plug 120. The stop ring 140 includes a position element 141 that is located in the restriction groove 125*a* for restraining the plug 120 from moving axially along the axis P. In the first embodiment, the user can put the plug 120 into the accommodation hole 112 of the cylinder 110 and let the stop end 122 of the plug 120 outside the accommodation hole 112, then dispose the stop ring 140 on the stop end 122 and press the position element 141 of the stop ring 140 into the restriction groove 125*a* of the plug 120 for restricting the axial movement of the plug 120.

Figure 11:
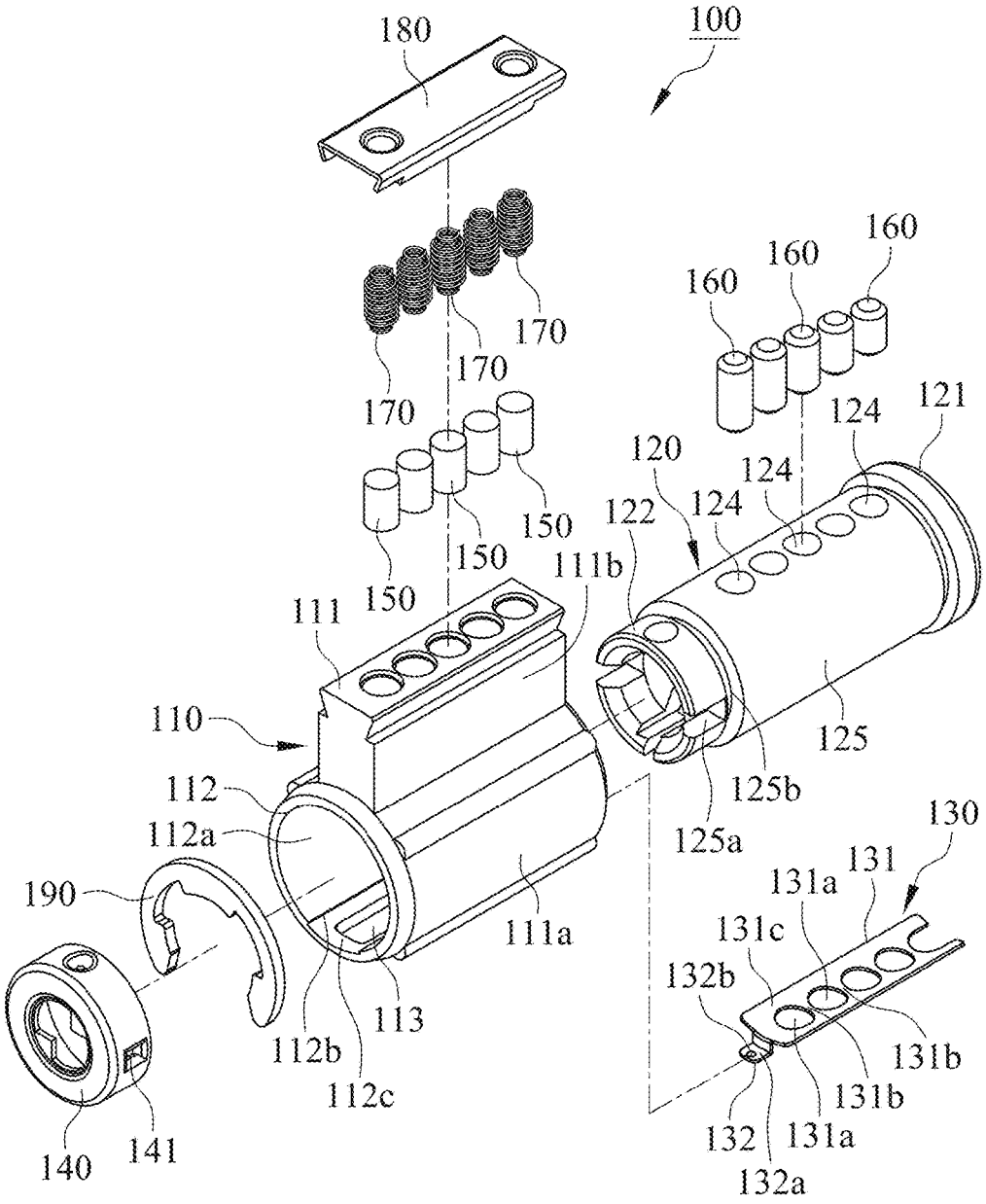
FIG. 11 is a perspective exploded diagram illustrating a rekeyable lock in accordance with a second embodiment of the present invention.
Figure 12:
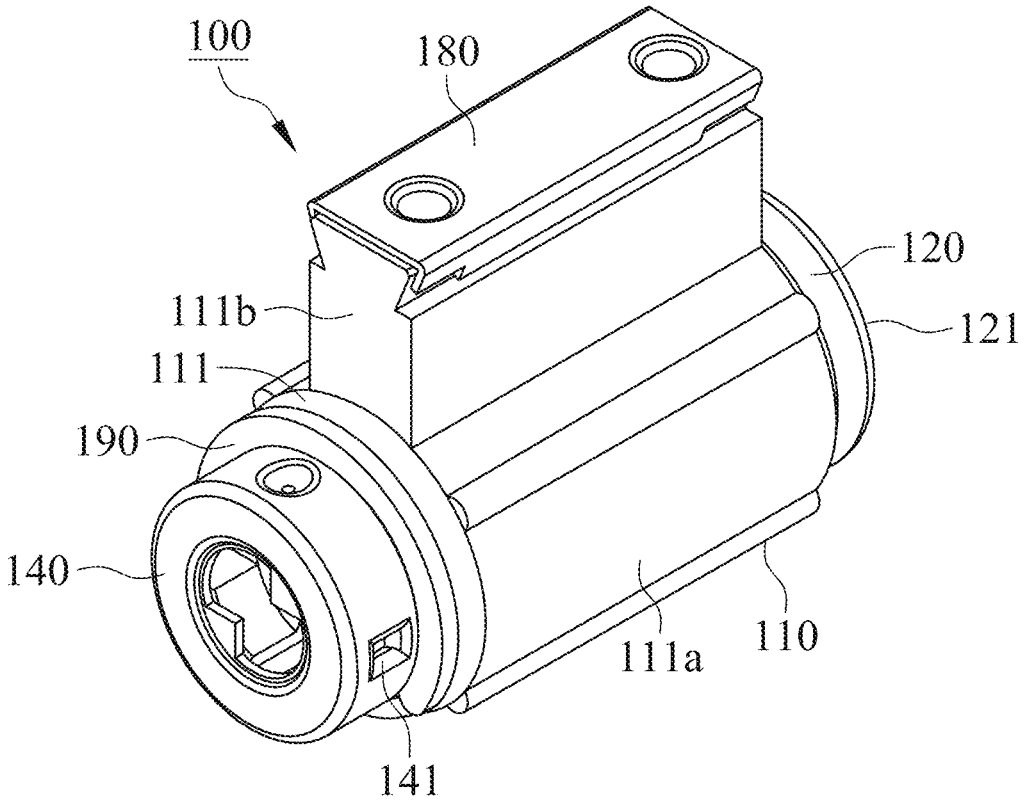
FIG. 12 is a perspective assembly diagram illustrating the rekeyable lock in accordance with the second embodiment of the present invention.

FIGS. 11 and 12 are the perspective exploded and assembly diagrams of a rekeyable lock 100 of a second embodiment. In the second embodiment, the rekeyable lock 100 further includes a ring groove 125*b* recessed on the external ring surface 125 of the plug 120 and a fastener 190 engaged in the ring groove 125*b*. The fastener 190 and the ring groove 125*b* in the second embodiment are provided to replace the position element 141 of the stop ring 140 and the restriction groove 125*a* of the plug 120 in the first embodiment, and they are also provided to restrain the plug 120 from moving axially along the axis P.

In the rekeyable lock 100 of the present invention, the blocker 130 is movably disposed in the accommodation hole 112 such that the bottom pins 160 can be removed from the through hole 113 or restricted in the cylinder 110. Otherwise, owing to the position portion 132 of the blocker 130 is positioned on the steady portion 114 located on the external surface 111*c* of the main body 111, the user can move the blocker 130 by hand or simple tool to change the bottom pins 160 for rapid key replacement.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A rekeyable lock comprising:

a cylinder including a main body, an accommodation hole and a through hole, the through hole penetrates through the main body and communicates with the accommodation hole;

a plug rotatably disposed in the accommodation hole;

a blocker movably disposed in the accommodation hole, wherein the blocker includes a block portion and a position portion connecting with each other, the block portion is located between the main body and the plug, and the position portion protrudes outside the accommodation hole via the through hole and is positioned on a steady portion of the main body;

the steady portion is located on an external surface of the main body;

the blocker is located at a first position, the position portion of the blocker is located in the through hole and is obstructed by the steady portion;

the steady portion includes a steady concave recessed on the external surface and the position portion of the blocker is located in the steady concave when the blocker is located at a second position; and the position portion includes a flexible arm and an emboss located on the flexible arm, a position concave is recessed in the steady concave of the steady portion, and the emboss is accommodated in the position concave when the blocker is located at the second position.

2. The rekeyable lock in accordance with claim 1 further comprising a plurality of bottom pins placed in a plurality of linear grooves of the plug, wherein the blocker at the first position is able to block the bottom pins and the blocker at the second position is able to allow the bottom pins to be removed from the through hole of the cylinder.

3. The rekeyable lock in accordance with claim 2, wherein the block portion of the blocker includes a plurality of bores and a plurality of connection ribs, the bottom pins are respectively blocked by the connection ribs when the blocker is located at the first position, and the bottom pins are respectively revealed by the bores and able to be removed through the bores and the through hole when the blocker is located at the second position.

4. The rekeyable lock in accordance with claim 1, wherein a guide groove is recessed on a hole wall of the accommodation hole and the through hole is formed on a bottom surface of the guide groove, the blocker is located in the guide groove and a top surface of the block portion does not protrude from the hole wall of the accommodation hole.

5. The rekeyable lock in accordance with claim 4 further comprising a stop ring engaged with a stop end of the plug for restraining the plug from moving axially along an axis, wherein when the blocker is located at the first position, the blocker is restricted in the guide groove by the steady portion of the cylinder and a key end of the plug.

6. The rekeyable lock in accordance with claim 5, wherein a restriction groove is recessed on an external ring surface of the plug and radially extends around the axis passing through the plug, and the stop ring includes a position element located in the restriction groove for restraining the plug from axially moving along the axis.

7. The rekeyable lock in accordance with claim 1 further comprising a stop ring which is engaged with a stop end of the plug for restraining the plug from axially moving along an axis.

8. The rekeyable lock in accordance with claim 7, wherein a restriction groove is recessed on an external ring surface of the plug and radially extends around the axis passing through the plug, and the stop ring includes a position element located in the restriction groove for restraining the plug from axially moving along the axis.

* * * * *